US010910758B2

(12) United States Patent
Kot

(10) Patent No.: US 10,910,758 B2
(45) Date of Patent: Feb. 2, 2021

(54) ELECTRICAL CONNECTOR WITH GUIDING FEATURE COMPRISING TWO RAMPS

(71) Applicant: Aptiv Technologies Limited, St. Michael (BB)

(72) Inventor: Lukasz Kot, Suloszowa (PL)

(73) Assignee: APTIV TECHNOLOGIES LIMITED

( * ) Notice: Subject to any disclaimer, the term of this patent is extended or adjusted under 35 U.S.C. 154(b) by 254 days.

(21) Appl. No.: 16/305,530

(22) PCT Filed: May 29, 2017

(86) PCT No.: PCT/EP2017/062929

§ 371 (c)(1),
(2) Date: Nov. 29, 2018

(87) PCT Pub. No.: WO2017/207505

PCT Pub. Date: Dec. 7, 2017

(65) Prior Publication Data

US 2020/0395705 A1 Dec. 17, 2020

(30) Foreign Application Priority Data

Jun. 2, 2016 (EP) ..... 16172634

(51) Int. Cl.
*H01R 13/506* (2006.01)
*H01R 13/436* (2006.01)

(52) U.S. Cl.
CPC ..... *H01R 13/506* (2013.01); *H01R 13/4365* (2013.01)

(58) Field of Classification Search
CPC ..... H01R 13/4365; H01R 13/4223; H01R 13/62955; H01R 13/62938; H01R 13/62977; H01R 13/62944; H01R 13/4362; H01R 13/4364; H01R 13/641; H01R 13/639; H01R 13/4361; H01R 13/6295; H01R 2201/26; H01R 13/502;
(Continued)

(56) References Cited

U.S. PATENT DOCUMENTS 5,059,142 A 10/1991 Ohta et al.
6,464,544 B1 10/2002 Yamamoto et al.
(Continued)

FOREIGN PATENT DOCUMENTS

WO 2006101816 A1 9/2006
WO 2010014540 A1 2/2010

*Primary Examiner* — Edwin A. Leon
*Assistant Examiner* — Matthew T Dzierzynski
(74) *Attorney, Agent, or Firm* — Robert Myers; Billion & Armitage

(57) ABSTRACT

An electrical connector includes a connector housing having a housing frame and a housing core. A housing core can be inserted in a housing frame. The housing core includes a latch protruding from the outer wall of the housing core and the housing frame includes locking means. The housing frame includes locking means. The locking means includes first and second guiding ramps. The first guiding ramp is configured to guide the latch upon insertion parallel to the extension direction of the interior wall of the housing frame onto the second guiding ramp. The second guiding ramp is configured to deflect the latch inwardly towards the interior of the housing frame.

14 Claims, 5 Drawing Sheets

(58) Field of Classification Search
CPC .. H01R 13/506; H01R 13/6272; H01R 43/20; H01R 13/4367; H01R 13/516; H01R 13/5219; H01R 13/62922; H01R 13/62966; H01R 13/631; H01R 13/4368; H01R 13/4538; H01R 13/5208; H01R 13/5221; H01R 13/62911
See application file for complete search history.

(56) References Cited

U.S. PATENT DOCUMENTS

| | | | | |
|---|---|---|---|---|
| 7,175,451 | B2 * | 2/2007 | Shuey | H01R 13/62955 439/157 |
| 7,628,648 | B1 | 12/2009 | Tan Chin Yaw et al. | |
| 8,550,860 | B2 * | 10/2013 | Dick | H01R 13/4365 439/752 |
| 8,651,901 | B2 * | 2/2014 | Beck, Jr. | H01R 13/4365 439/752 |
| 10,276,977 | B2 * | 4/2019 | Lesniak | H01R 13/62977 |
| 2007/0020997 | A1 * | 1/2007 | Miyakawa | H01R 13/4364 439/595 |
| 2012/0282800 | A1 | 11/2012 | Beck, Jr. et al. | |

* cited by examiner

ELECTRICAL CONNECTOR WITH GUIDING FEATURE COMPRISING TWO RAMPS

CROSS-REFERENCE TO RELATED APPLICATIONS

This application is a national stage application under 35 U.S.C. § 371 of PCT Application Number PCT/EP2017062929 having an international filing date of May 29, 2017, which designated the United States and claimed priority under Article 8 of the Patent Cooperation Treaty to application Ser. No. 16/172,634.4 filed in the European Patent Office on Jun. 6, 2016, the entire disclosure of each of which is hereby incorporated herein by reference.

TECHNICAL FIELD OF THE INVENTION

The invention relates to an electrical connector with a guiding feature having two ramps.

BACKGROUND OF THE INVENTION

Electrical connector systems are used for joining electrical circuits in which a male contact terminal is typically mated with a female contact terminal. The terminals are arranged in respective connector housings to allow a safe and reliable mating process. In many applications, a particularly safe and reliable coupling of contact terminals is of high importance. Some connector applications include a large amount of electrically conductive contact terminals and have to be connected in a very constrained space. This is often the case in automotive applications where electrical connections need to be reliably established at locations which are difficult to access, e.g. behind dashboards. In such cases, the mating process can be facilitated by providing connectors that include means for multiple connection terminals to achieve a proper positioning of the terminals within the connector. Accordingly, the properly aligned terminals can be mated with corresponding counterparts by using further supportive means such as mate-assist devices and further positioning devices.

International Patent Application WO 2006/101816 A1 shows a typical connector assembly, including a mate-assist lever in which the rotational movement of the mate-assist lever leads to an engagement of the connector housing with a counter connector to establish an electrical connection. A first mechanical lock in form of a cantilever latch and a catch is provided, which prevents the lever from moving out of the mated position. Additional mating safety is provided by a CPA (connector position assurance device) which is slideably guided on the top surface of the connector housing.

An example for an electrical connector including a TPA (terminal position assurance device) is shown in US Patent Application Publication 2012/0282800, wherein an electrical connector is disclosed having a housing having a row of terminal receiving passageways. Each passageway includes a locking latch. An overstress protection rib is positioned below each latch and a channel extends through a front wall of the housing and adjacent to the row of terminal receiving passageways and on the opposite side of the latch. The TPA has a pre-locked position with the TPA positioned forward of the latch allowing the latch to reside into the channel and a fully locked position where the TPA is positioned underneath the latch.

Another example of a connector including a TPA including a housing and a matrix body is shown in the U.S. Pat. No. 7,628,648. The housing defining a housing cavity has a forwardly-projecting U-shaped member that defines a U-shaped recess portion of the housing cavity.

According to the state-of-the art, different housing means such as cavities can be formed to house and align the electrical conductive parts by assembling multiple parts of the connector, for instance a connector body with a connector frame in a defined way. Further, safeguarding means, such as protrusions and corresponding recesses, can prevent a potentially incorrect assembly of the connector by blocking any misaligned parts. Another solution for preventing false assembly is to visually indicate if any parts are misaligned. Accordingly, orientation of the parts can be corrected and assembly of the connector can be processed.

However, manual correction of misaligned parts is time consuming and increases the complexity to the assembly process. Also the use of multiple means for aligning and respectively safeguarding the position of the assembled parts increases complexity of the connector assembly.

Thus, it is objective of the present invention to provide a connector assembly with a facilitated alignment and a safe assembly of the parts of the connector assembly.

SUMMARY OF THE INVENTION

The above objectives are solved by a connector assembly described herein. In particular the objectives are solved by an electrical connector including a connector housing, wherein the housing includes a housing frame and a housing core, wherein the housing core can be inserted in the housing frame; and wherein the housing core includes a latch protruding from the outer wall of the housing core. The housing frame includes a corresponding locking means arranged on an interior wall of the frame to engage said latch, wherein the housing core includes a contact terminal receiving cavity. The locking means includes first and second guiding ramps as seen in an insertion direction for guiding the housing core into its proper position in the housing frame, wherein the first guiding ramp is configured to contact the latch upon insertion of the housing core to guide the housing core parallel to the extension direction of the interior wall of the housing frame onto the second guiding ramp, and wherein the second guiding ramp is arranged behind the first guiding ramp seen in insertion direction and is configured to contact the latch upon insertion of the housing core and is configured to deflect the latch inwardly towards the interior of the housing frame.

The electrical connector presented herein fulfils the requirement of an unambiguously positioned housing core in the housing frame with a facilitated assembly. Upon assembly, the housing core can be inserted in the housing frame. Initially the latch of the housing core can be received by an upper portion of the locking means which can include a relatively broad opening. Thus a simple first alignment of the housing frame and the housing core can be achieved. Movement of the housing core in the direction perpendicular to the extension direction of the interior wall of the housing frame can be delimited by a direct contact of the latch with the interior wall of the housing frame. Thus, after first reception of the latch, only a movement of the housing core parallel to the extension direction of the interior wall of the housing frame is allowed. During further insertion, the latch can contact the first guiding ramp which prevents the latch from a further movement coaxially to the insertion direction. Thus, the latch, and accordingly the whole housing core, is guided along said first guiding ramp towards the second guiding ramp. Thus an engagement of the latch and the second guiding ramp can be ensured. The latch can be elastically bent inwardly towards the interior of the frame while it is guided over the second guiding ramp. Thus the latch is in a condition where it could be received by an appropriate arresting means behind the second guiding ramp which can be properly formed to receive the latch and arrest and safeguard the latch in an unambiguously defined position.

As the guidance of the latch is performed automatically during movement of the housing core in insertion direction, an additional control of a correct alignment of the housing core relative to the housing frame is not necessary. Thus, the assembly of the connector housing core with the connector housing frame is significantly simplified since a user, after the first insertion in the housing frame, only needs to push the housing core without considering further alignments of the housing core. Hence, assembly process is facilitated and includes an increased robustness against false alignment because it prevents any potential manual mistakes during insertion. Also, since there is no need for an additional control of a proper positioning of the housing core and the housing frame, the whole assembly process is faster. Further, the invention allows for more space saving connector designs since for instance no additional moving parts are needed to secure the correct position of the housing core in the housing frame. Even further, if the connector is designed as a sealed connector, the seal is properly secured during disassembly of the connector.

In a preferred embodiment, the locking means on the frame includes a first inner side wall, a second inner side wall, and an inner back wall which is formed to connect one end of each inner side wall to form a recess extending in insertion direction. In other words, the recess has essentially a U-shaped cross-section. The latch of the housing core can be initially received by the upper portion of the recess. Thus, to facilitate initial reception, the upper portion of the recess can be dimensioned to have a larger extension parallel to the extension direction of the interior wall of the housing frame (and perpendicular to the insertion direction). Upon reception, the latch can contact the inner back wall of the guiding means, hence delimiting further movement towards to the inner back wall. Also the side walls may contact the locking latch upon reception. Hence, the inner back wall, as well as the inner side walls should include sufficient mechanical stability to receive and guide the latch.

In another preferred embodiment, the first guiding ramp inclines along insertion direction to guide the latch towards the second inner side wall. At the end of the first guiding ramp the extension length of the recess may be narrowed down to the extension length of the latch. Thus, the latch can be tightly received and further movement of the latch is delimited to a movement parallel to the insertion direction. Thus, a distinct position of the latch and accordingly the housing core parallel to the extension direction of the interior wall of the housing frame is defined.

In another preferred embodiment, the latch includes an inclined latch contact surface, formed to engage a corresponding first guiding ramp contact surface such that the first guiding ramp contact surface and the latch contact surface extend essentially parallel upon engagement. In here, both contact surfaces engage in a parallel manner, which increases the contact area between the latch and the first guiding ramp. Thus additional stabilization of the latch during the guidance along the first guiding ramp is provided and alignment of the locking latch is facilitated.

In another preferred embodiment, the first guiding ramp contact surface is beveled in a second direction such that a protrusion extending from the distal end of the latch in insertion direction is guided towards the inner back wall. Thus, the contact surface can be formed, such that it inclines as seen in direction perpendicular towards the inner back wall. The protrusion is thus guided towards the inner back wall upon contact of the latch with the first guiding ramp. Any movement of the latch in a direction away from the inner back wall is accordingly prevented. Thus a proper contact of the latch with the inner back wall can be safeguarded during the guidance of the latch along the first guiding ramp. This guidance provides additional stabilization of the latch.

In another preferred embodiment, the second guiding ramp extends parallel to the insertion direction at the inner back wall, and wherein the second guiding ramp inclines along insertion direction to deflect the latch inwardly towards the interior of the housing frame. Thus the latch is guided over the second guiding ramp and preferably continuously deflected. The elastic deflection towards the interior of the housing frame facilitates further arresting of the latch in a subsequently arranged arresting means, for instance a recess.

In another preferred embodiment, the second guiding ramp is located in a guiding portion, which is formed to tightly receive the latch preventing movement of the latch parallel to the extension direction of the interior wall of the housing frame after reception. Thus, the latch is delimited to only be movable in insertion direction, once it has passed the first guiding ramp. This ensures that the latch contacts the second guiding ramp at a clearly defined position. Since the second guiding ramp has preferably the same length parallel to the extension direction of the interior wall of the housing frame, the embedding of the second guiding ramp in the guiding portion that corresponds to the length of the latch ensures that the latch contacts the second guiding ramp over its full extension length and not just partially. This has the effect that the bending movement of the latch is smooth and uniform, since the side walls tightly guide the latch.

In another preferred embodiment, a latch arresting portion is formed behind the second guiding ramp as seen in insertion direction, which is formed to receive the latch and formed to undercut the second guiding ramp, preventing movement of the latch against insertion direction after reception. Further movement of the latch in insertion direction can also be prevented by a correspondingly formed latch arresting portion, thus the housing core defines a distinct position coaxially to the insertion direction after full reception. Since the latch arresting portion can further be formed so as to tightly receive the latch, e.g. also movements in any other direction can be prevented thus setting the latch and accordingly the housing core to an unambiguous position within the housing frame. As the locking latch abruptly snaps behind the second guiding ramp and into the arresting portion, proper arrestment of the latch can be verified by an acoustic feedback. Further, a visual indication is provided to check if the latch is at least partially hidden in the corresponding arresting portion or not, thus indicating if the latch is fully received. The mechanism also has the advantage that no further means are needed to safeguard the latch in the arresting position, hence facilitating the assembly.

In another preferred embodiment, gaps are formed along the inner side walls in insertion direction to create respective recesses between the inner side walls and the first and second guiding ramps. The gaps allow the locking means to be more flexible and allow them to bend out during assembly. Alternatively, the introduction of gaps creates space for instance for a potential application of further parts of the connector during the assembly. In here, the guiding ramps are not directly connected to the inner side walls of the locking means. Hence, the guiding ramps are only connected to the inner back wall of the locking means.

In another preferred embodiment, the housing frame and the housing core are each integrally formed, preferably as single molded parts. The housing frame and the housing core are preferably made of a robust and insulating material to protect the housed electrically conductive terminals from physical damages and moisture intrusion.

In another preferred embodiment, the housing frame and the housing core include one or more contact terminal receiving cavities extending in insertion direction and formed to house electrically conductive terminals, and wherein the contact terminal receiving cavities of the housing core and the housing frame are aligned along insertion direction after full insertion of the housing core in the housing frame. Thus, a contact terminal receiving cavity of the housing and a corresponding contact terminal receiving cavity of the core can be aligned such that a combined contact terminal receiving cavity is formed by the two cavities as to receive and house a contact terminal. Thus, the position of a housed contact terminal is well defined. Any displacement of the housing core and the housing frame and accordingly the respective cavities would lead to a misalignment of the cavities and thus to a non-properly formed combined contact terminal receiving cavity. Hence, a stable fixation of both components is desired to overcome mechanically challenging conditions, which can for instance arise in a car when the connector experiences vibrations and/or hits.

In another preferred embodiment, the housing core, when fully inserted into the housing frame, can be disposed relative to the housing frame to provide a terminal position assurance function. In here, the housing core can be moved, for instance parallel to the extension direction of the interior wall of the housing frame after the corresponding latch was guided to a latch arresting portion. Thus, the latch arresting portion is formed to allow further movement of the latch in the direction parallel to the extension direction of the interior wall of the housing frame and perpendicular to the insertion direction. Housed contact terminals can thus be engaged and safeguarded at a distinct position similar as with the TPA devices in the above referenced prior art.

In another preferred embodiment, the connector is a High Density Connector (HDC). The above described connector is in particular interesting for electrical connectors in cars, where a particular reliability in connectivity and robustness of the connector is required.

BRIEF DESCRIPTION OF THE SEVERAL VIEWS OF THE DRAWING

For a better understanding of the present invention and to appreciate its practical applications, the following figures are provided and referenced hereafter.

DETAILED DESCRIPTION OF THE INVENTION

In the following the present invention will now be described in more detail hereinafter with reference to the accompanying figures, in which exemplary embodiments of the invention are illustrated. However, the present invention may be embodied in different forms and should not be construed as limited to the embodiments set forth herein. Rather, these examples are provided so that this disclosure will be thorough and will convey the scope of the invention to persons skilled in the art.

Figure 1:
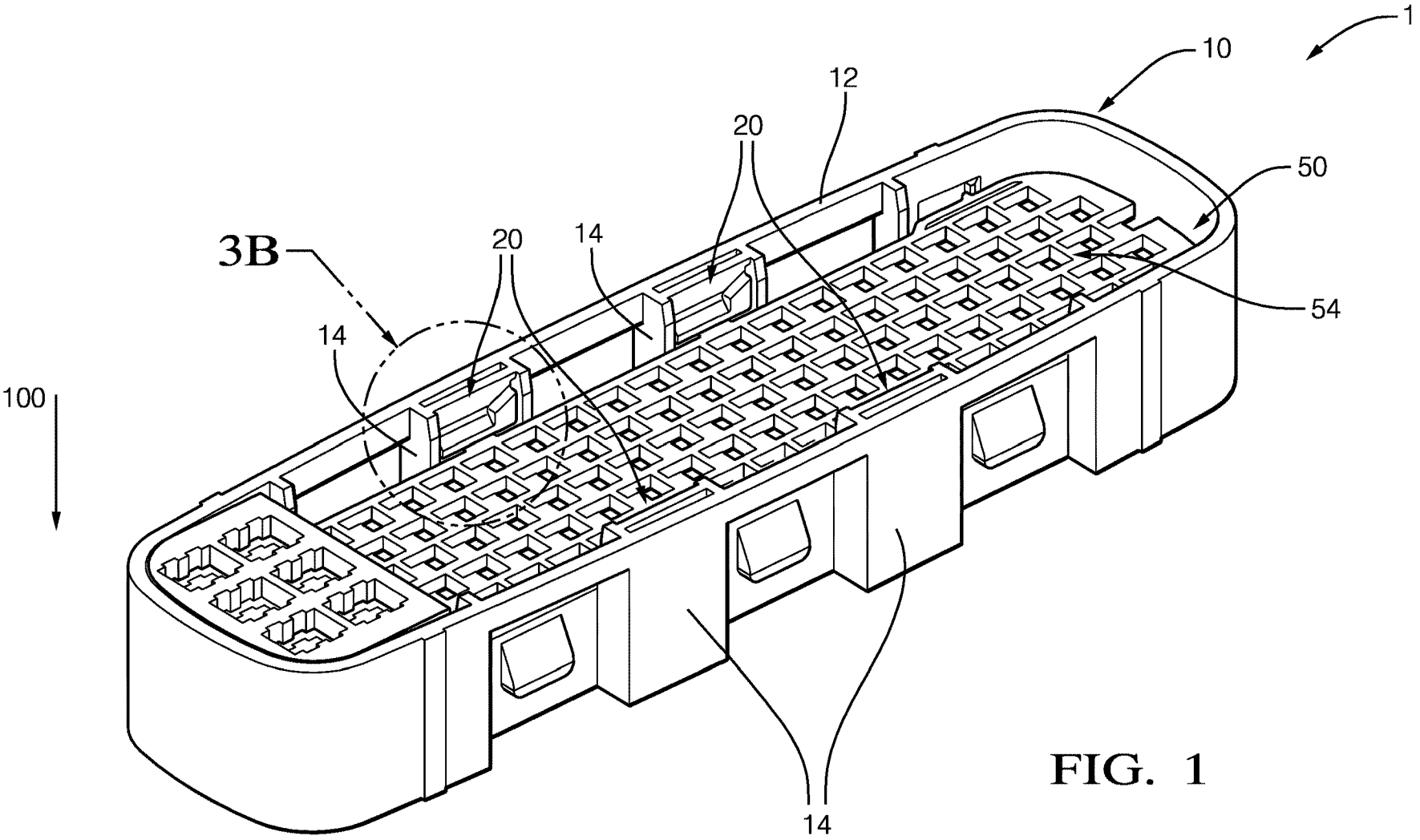
FIG. 1 shows an oblique top view of a top connector with a housing frame and an inserted housing core.

FIG. 1 shows an embodiment of a connector housing 1 in assembled condition. In here a housing core 50 is fully inserted in a housing frame 10. The housing frame 10 includes horizontal webs 12, which connect vertical racks 14 at which in turn locking means 20 are located. The arrangement of vertical racks 14 and webs 12 can form recesses at the outer walls of the housing frame 10 which can reduce weight of the connector and can also reduce material costs, compared to a connector design including continuous outer walls. The housing core 50 further includes contact terminal receiving cavities 54 which are formed to house electrically conductive contact terminals. The size of the housing frame 10 and the housing core 50 can be varied as desired, and also the number and size of the contact terminal receiving cavities 54 can be varied, dependent on the requirements of the connection to be established. Each of the housing core 50 and the housing frame 10 are integrally formed to achieve a high mechanical stability and facilitate the assembly of the components.

Figure 2:
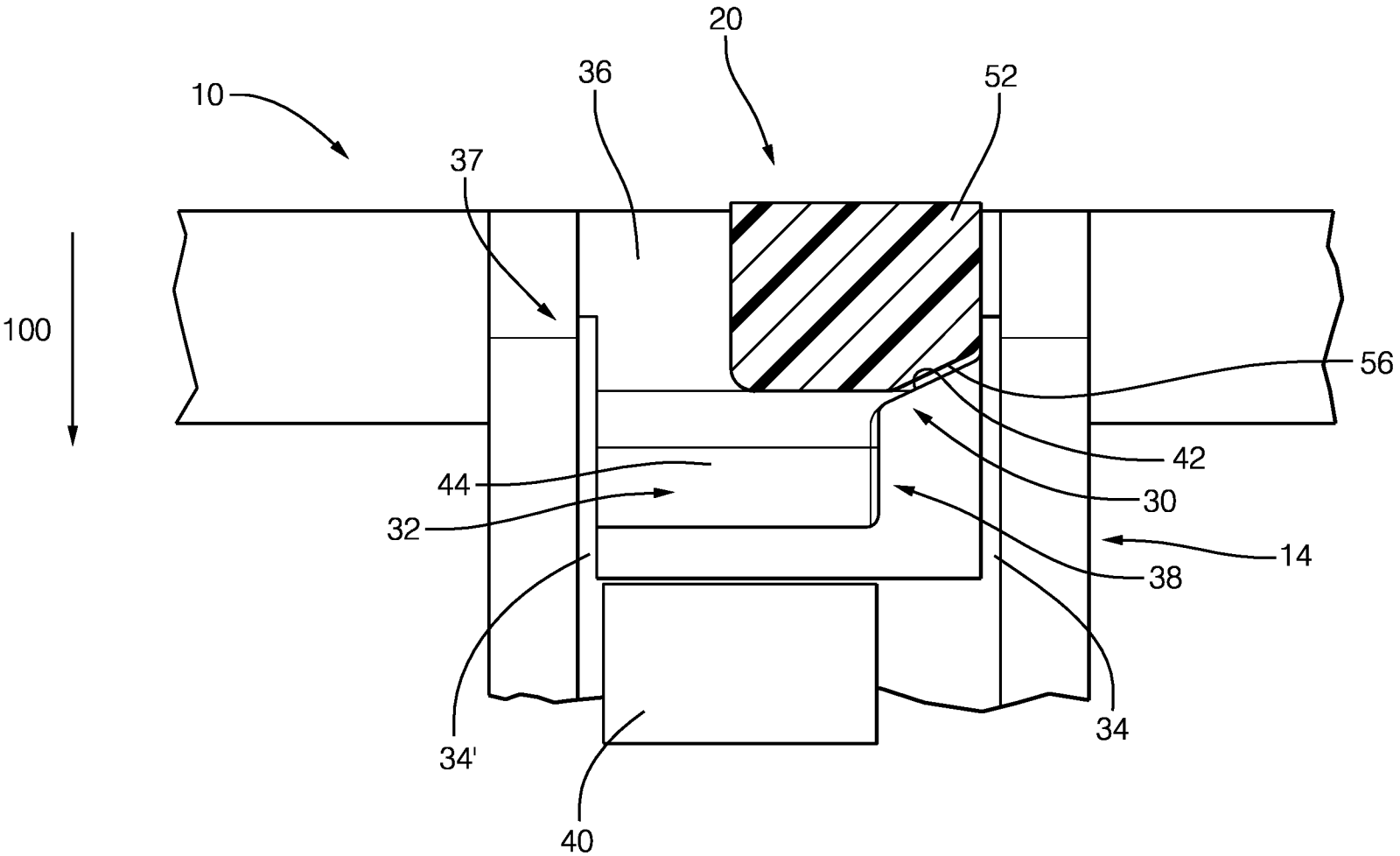
FIG. 2 shows a cross-sectional front view of the locking means at initial insertion of the housing core.

FIG. 2 shows a close up front view of the cross-section of the locking means 20, which is located at the upper end of the vertical rack 14 of the housing frame 10, as seen in insertion direction 100. The figure shows the housing core 50 at the beginning of the insertion into the housing frame 10 so that a latch 52 protruding from the housing core 50 is received by an upper portion 37 of the locking means 20. The size of the upper portion 37 of the locking means 20 is determined by opposed first 34 and second inner side walls 34', which extend in insertion direction 100 and which are spaced apart from each other and face each other. Both first 34 and second inner side walls 34' are connected at one end to an inner back wall 36. As depicted, the upper portion 37 of the locking means 20 that initially receives the latch 52 include a larger size than the extension of the latch 52 parallel to the extension direction of the interior wall of the housing frame 10. The figure depicts a condition of a maximum displacement of the latch 52 in the upper portion 37 of the locking means 20 along the direction parallel to the extension direction of the interior wall of the housing frame 10. More specifically, the latch 52 is located proximate to the first inner side wall 34. However, at the beginning of the insertion, the latch 52 could also be inserted anywhere else parallel to the extension direction of the interior wall of the housing frame 10 in the upper portion 37 of the locking means 20.

During the insertion of the housing core 50, the latch 52 is directed downwardly in insertion direction 100 until it engages a first guiding ramp 30. The latch 52 includes a latch contact surface 56, which engages a corresponding first guiding ramp contact surface 42. Thus, further movement strictly coaxially to the insertion direction 100 is blocked. The first guiding ramp contact surface 42 is inclined, as depicted, towards the second inner side wall 34', as seen in insertion direction 100. In the figure the latch contact surface 56 also includes an inclined surface, which matches the inclined surface from the first guiding ramp contact surface 42 so that both contact surfaces are arranged parallel upon engagement. This provides an increased area of engagement between the latch 52 and the first guiding ramp 30 and thus leads to a better stability and guidance of the latch 52 during the insertion process. Further, a second guiding ramp 32 including a second guiding ramp contact surface 44 is arranged below the first guiding ramp 30 as seen in insertion direction 100. As shown, the second guiding ramp 32 is dimensioned as to tightly receive the latch 52 in a guiding portion 38 formed above and across the second guiding ramp 32 by the first inner side wall 34 and the opposite second inner side wall 34'. Thus movement of the latch 52 in insertion direction 100 is guided along the second inner side wall 34', ensuring that the latch 52 is properly guided to and across the second guiding ramp 32. The second guiding ramp contact surface 44 extends, as seen in insertion direction 100 along the inner back wall 36 of the locking means 20 and is inclined such that the latch 52 can be deflected inwardly towards the interior of the housing frame 10, when it passes in insertion direction (downward in FIG. 2) the second guiding ramp 32.

Below the second guiding ramp 32 a latch arresting portion 40 is arranged, which undercuts the lower end of the second guiding ramp 32 to prevent further movement of the latch 52 against insertion direction 100, once the latch 52 is received. Hence, an unintentional disassembly of the housing core 50 from the housing frame 10 is prevented. Preferably, the latch arresting portion 40 includes a larger extension along the direction parallel to the extension direction of the interior wall of the housing frame 10 so that the latch 52 can be moved coaxially to said direction after it was received by the latch arresting portion 40. This can for instance provide a terminal position assurance function, which can be activated when the housing core 50 is relatively disposed to the housing frame 10.

Figure 3A:
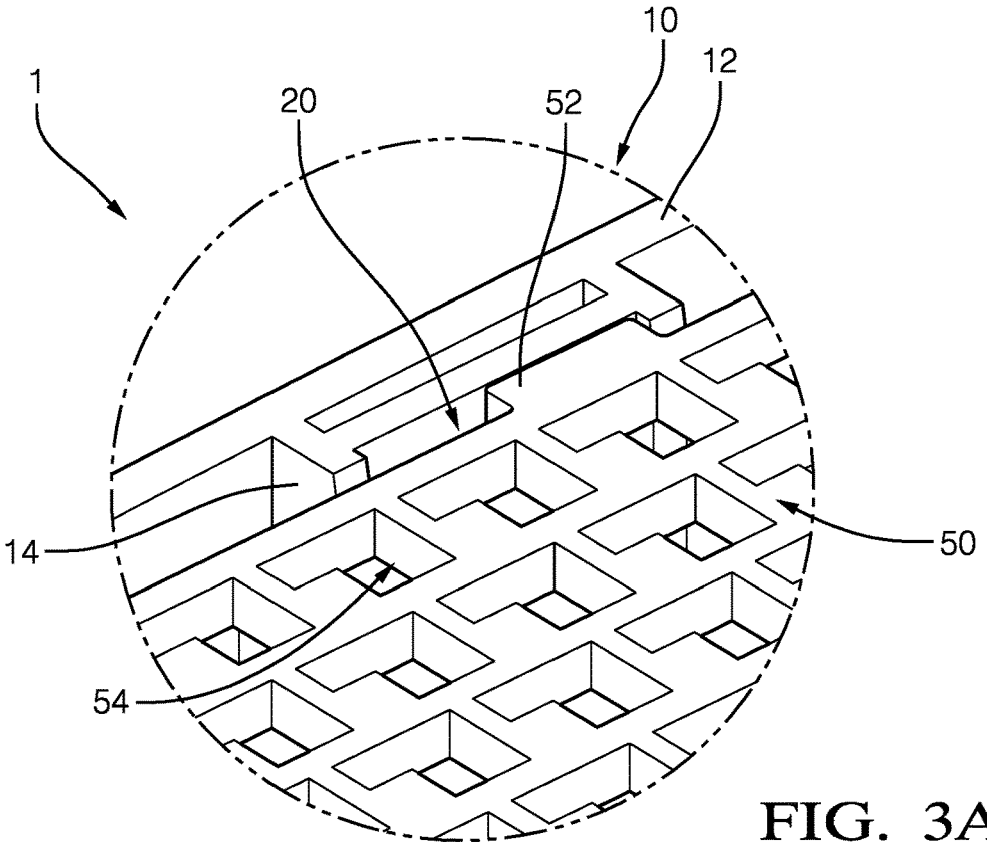
FIGS. 3A-B show an oblique top view of the locking means at initial (A) and at full (B) insertion of the housing core.

FIG. 3A shows the locking means 20 of the connector housing 1 in an oblique top view at a state of initial insertion of the housing core 50 in the housing frame 10. The latch 52 of the housing core 50 is initially received by the upper portion 37 of the locking means 20, which is similar to the state depicted in FIG. 2. Once received, further movement of the latch 52 in insertion direction 100 is blocked by the first guiding ramp 30 as long as the latch 52 is not aligned along the opposite second inner side wall 34'. As depicted in FIG. 3A, the top surface of the housing core 50 is aligned with the top surface of the housing frame 10. This provides a visual control for a user if the housing core 50 is in an inserted condition or not.

Figure 3B:
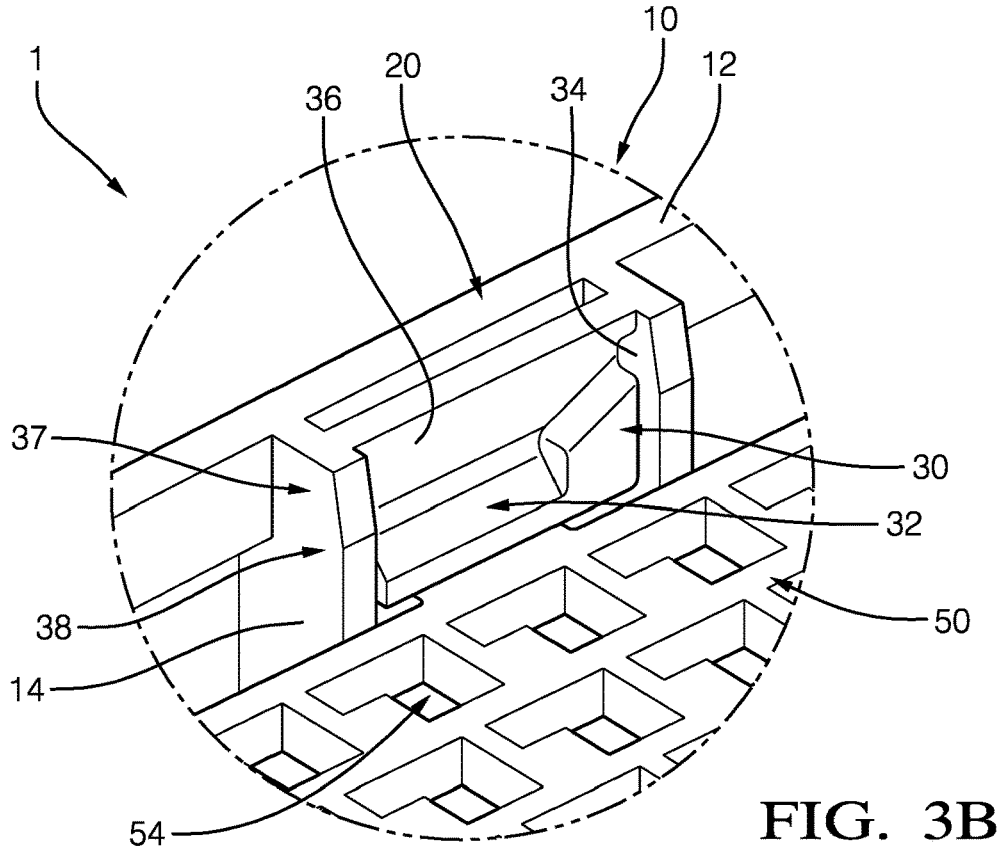

FIG. 3B shows a condition of the connector housing 1, wherein the insertion process is finished and the housing core 50 is fully inserted in the housing frame 10. As depicted, the locking means 20 are arranged in the vertical racks 14, which are located above the upper surface of the housing core 50. From FIG. 3B it can be seen, that the first guiding ramp 30 is inclined so that the latch 52 is driven towards the opposite second inner side wall 34', while the latch 52 is directed further in insertion direction 100. Thus the latch 52, and accordingly the whole housing core 50, is shifted to a distinct position in the direction parallel to the extension direction of the interior wall of the housing frame 10. The latch 52 is further guided to the second guiding ramp 32, which is located behind the first guiding ramp 30 as seen along insertion direction 100, which inclines from the inner back wall 36. In FIG. 3B a condition is shown, wherein further movement of the latch 52 against (opposite) insertion direction 100 is blocked because the latch 52 is received by the latch arresting portion 40, which undercuts the second guiding ramp 32. Thus an unintended disassembly of the housing core 50 from the housing frame 10 is prevented. Further it is depicted that the contact terminal receiving cavities 54 of the housing core 50 can align with corresponding cavities in the housing frame 10 in the assembled condition. Thus combined cavities that extend through the housing frame 10 and the housing core 50 can be formed, which are suitable to house for instance electrical contact terminals.

Figure 4A:
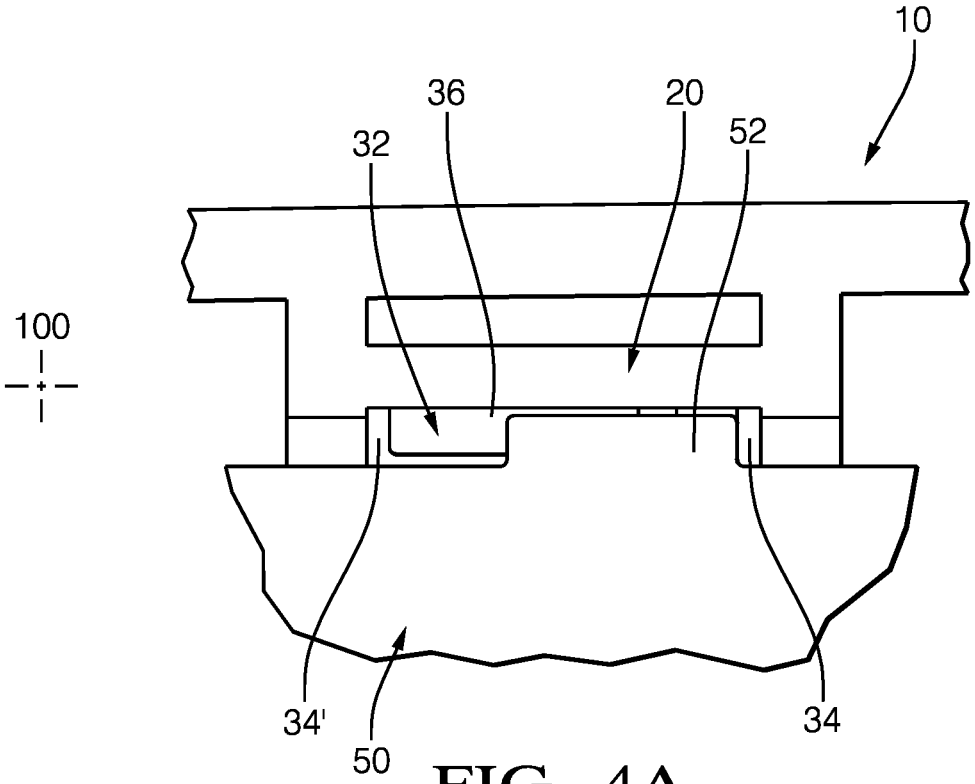
FIGS. 4A-B show a top view of the locking means at initial (A) and at full (B) insertion of the housing core.

FIG. 4A shows the locking means 20 from a top view in the state of initial reception of the latch 52 in the upper portion 37, similar to FIG. 3A. As depicted, the latch 52 is received proximate to the first inner side wall 34 and spaced apart from the opposite second inner side wall 34' at a maximum distance. In other words this is the "worst case" of displacement of a latch 52, which is received by the locking means 20. As depicted, the outer surfaces of the walls of the housing core 50 engage the corresponding outer surfaces of the inner side walls that extend parallel to the extension direction of the interior wall of the housing frame 10, thus preventing the housing core 50 from movement perpendicular towards the interior wall of the housing frame 10. This guidance of the housing core 50 can also be further supported by an engagement of the latch 52 with the inner back wall 36 of the housing frame 10.

Figure 4B:
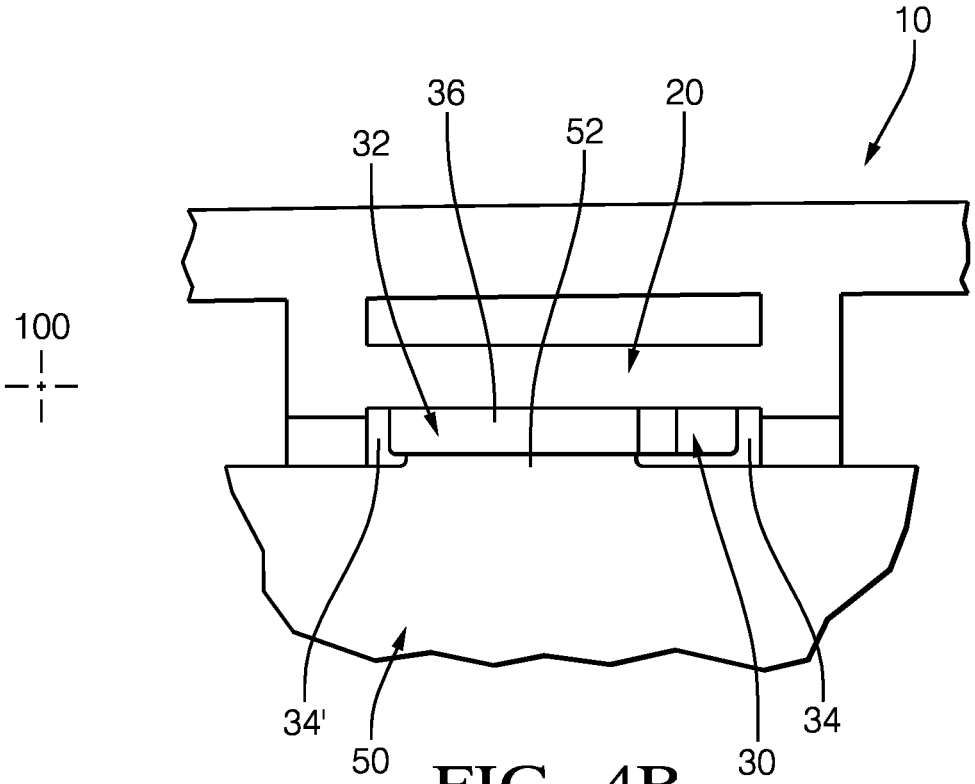

FIG. 4B shows the locking means 20 in the state where the latch 52 is fully received by the latch arresting portion 40. As described, the latch arresting portion 40 undercuts the second guiding ramp 32, thus movement of the latch 52 against insertion direction 100 is prevented. The reception of the latch 52 can be used as a visual verification of a fully inserted housing core 50. In FIG. 4B the latch 52 was firstly guided by the first guiding ramp 30 towards the second inner side wall 34' parallel to the extension direction of the interior wall of the housing frame 10 and secondly over the second guiding ramp 32 to the latch arresting portion 40. Further movement of the latch 52 parallel to the insertion direction 100 and parallel to the extension direction of the interior wall of the housing frame 10 can be prevented by a tight reception of the latch 52 in the latch arresting portion 40. Thus a distinct position of the housing core 50 within the housing frame 10 is defined. Hence, a proper positioning can be achieved without the need for further manual adjustments. This renders the connector housing 1 robust against assembly errors, as the only manual action, after the initial insertion, is a corresponding pushing of the housing core 50 in insertion direction 100.

Figure 5:
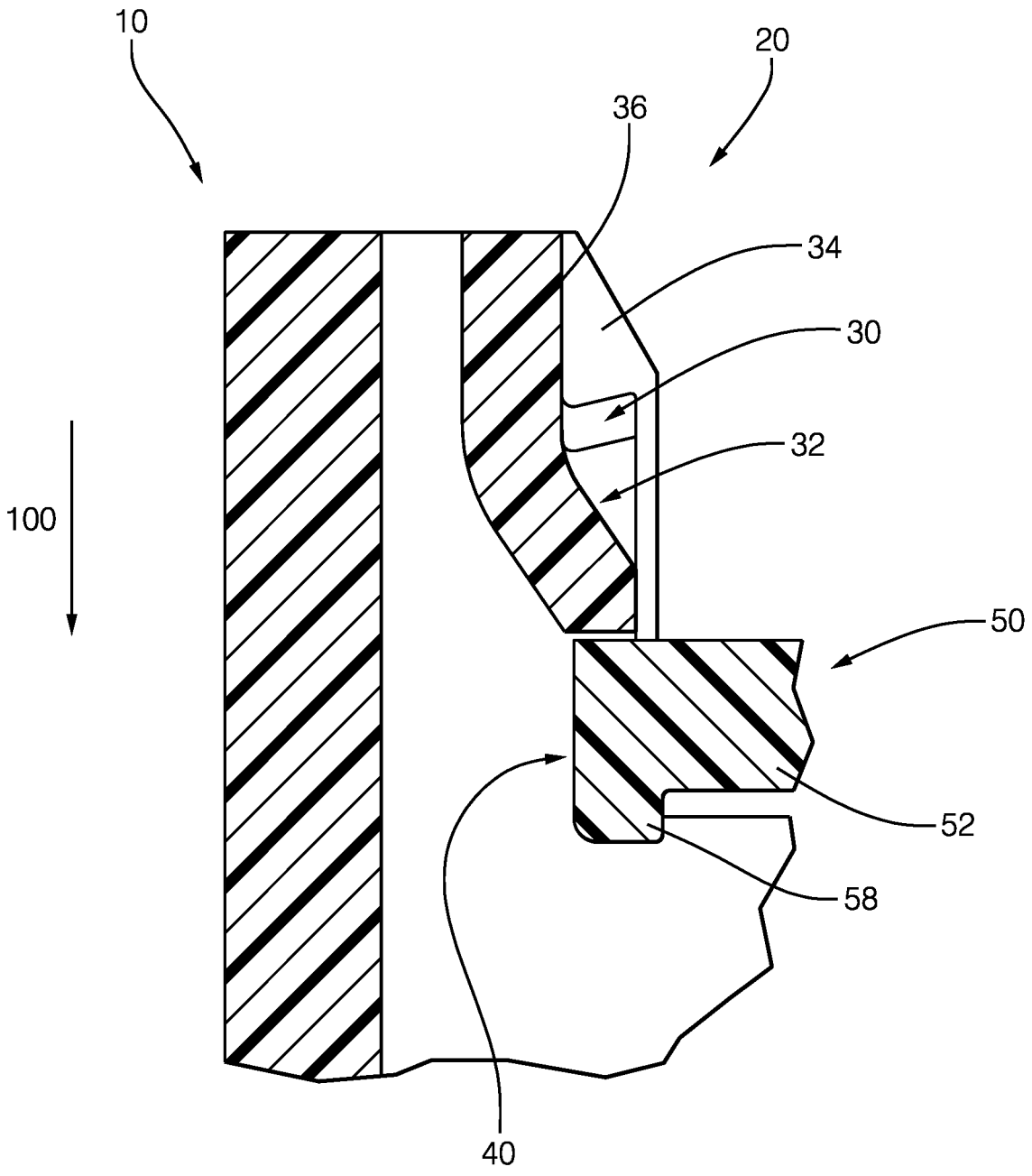
FIG. 5 shows a cross-sectional side view of the locking means at full insertion of the housing core.

FIG. 5 shows a cross-sectional side view of the locking means 20, wherein the housing core 50 is in the fully inserted condition. Here the latch 52 of the housing core 50 is received by the latch arresting portion 40, which is located behind the second guiding ramp 32, as seen in insertion direction 100. Engagement of the latch 52 with the second guiding ramp 32 prevents the latch 52, and accordingly the housing core 50, from any movement against insertion direction 100. The first guiding ramp 30 inclines from the first inner side wall 34 towards the opposite second inner side wall 34', whereas the second guiding ramp 32 inclines from the inner back wall 36 towards the interior of the frame, as seen in insertion direction 100. As depicted, the latch 52 further includes a protrusion 58 at its distal end extending in insertion direction 100. Further, an additional beveling of the first guiding ramp 30 is shown, such that the first guiding ramp 30 is additionally inclined as to guide the protrusion 58 towards the inner back wall 36. Thus, the additional beveling leads to a safeguarding of the latch 52 at the first guiding ramp 30 upon reception, while the latch 52 is guided along the first guiding ramp 30. Thus, an undesired slip off of the latch 52 can be prevented.

The invention claimed is:

1. An electrical connector, comprising:

a connector housing, wherein the connector housing comprises a housing frame and a housing core, wherein the housing core can be inserted in the housing frame, wherein the housing core comprises a latch protruding from an outer wall of the housing core, wherein the housing frame comprises a corresponding locking means arranged on an interior wall of the housing frame to engage said latch, wherein the housing core comprises a contact terminal receiving cavity;

wherein the corresponding locking means comprises a first guiding ramp and second guiding ramp each configured to guide the housing core into a proper position in the housing frame;

wherein a first inclination direction of the first guiding ramp is different than a second inclination direction of the second guiding ramp;

wherein the first guiding ramp is configured to contact the latch upon insertion of the housing core to guide the housing core parallel to an extension direction of the interior wall of the housing frame onto the second guiding ramp, and wherein the second guiding ramp is arranged behind the first guiding ramp and is configured to contact the latch upon insertion of the housing core and is configured to deflect the latch inwardly towards the interior of the housing frame.

2. The electrical connector according to claim 1, wherein the corresponding locking means comprises a first inner side wall, a second inner side wall, and an inner back wall which is formed to connect one end of the first and second inner sides wall to form a recess extending in an insertion direction.

3. The electrical connector according to claim 2, wherein the first guiding ramp inclines along the insertion direction and is configured to guide the latch towards the second inner side wall.

4. The electrical connector according claim 2, wherein the latch comprises an inclined latch contact surface formed to engage a corresponding first guiding ramp contact surface such that a first guiding ramp contact surface and a latch contact surface extend essentially parallel upon engagement.

5. The electrical connector according to claim 4, wherein the second guiding ramp extends parallel to the insertion direction at the inner back wall; and wherein the second guiding ramp inclines along the insertion direction to deflect the latch inwardly towards the interior of the housing frame.

6. The electrical connector according to claim 2, wherein a latch arresting portion is formed behind the second guiding ramp which is formed to receive the latch and formed to undercut the second guiding ramp, thereby preventing movement of the latch against the insertion direction after reception.

7. The electrical connector according to claim 2, wherein the housing frame and the housing core comprise contact terminal receiving cavities extending in the insertion direction and formed to house electrically conductive terminals and wherein the contact terminal receiving cavities of the housing core and the housing frame are aligned along the insertion direction after full insertion of the housing core in the housing frame.

8. The electrical connector according to claim 1, wherein the second guiding ramp is located in a guiding portion which is formed to tightly receive the latch, thereby preventing movement of the latch parallel to the extension direction of the interior wall of the housing frame after reception.

9. The electrical connector according to according to claim 1, wherein the housing frame and the housing core are integrally formed.

10. The electrical connector according to claim 1, wherein the housing core, when fully inserted into the housing frame, is disposed relative to the housing frame to provide a terminal position assurance function.

11. The electrical connector according to claim 1, wherein the electrical connector is a High Density Connector.

12. The electrical connector according to claim 1, wherein the first guiding ramp inclines from the first inner side wall towards the opposite second inner side wall and wherein the second guiding ramp inclines from the inner back wall towards an interior of the frame.

13. An electrical connector, comprising:

a connector housing, wherein the connector housing comprises a housing frame and a housing core, wherein the housing core can be inserted in the housing frame, wherein the housing core comprises a latch protruding from an outer wall of the housing core;

wherein the housing frame comprises a corresponding locking means arranged on an interior wall of the housing frame to engage said latch, wherein the corresponding locking means comprises a first guiding ramp configured to contact the latch upon insertion of the housing core to guide the housing core parallel to an extension direction of the interior wall of the housing frame onto the second guiding ramp, a second guiding ramp arranged behind the first guiding ramp and is configured to contact the latch upon insertion of the housing core and is configured to deflect the latch inwardly towards the interior of the housing frame, a first inner side wall, a second inner side wall, and an inner back wall which is formed to connect one end of the first and second inner sides wall to form a recess extending in an insertion direction, wherein the latch comprises an inclined latch contact surface formed to engage a corresponding first guiding ramp contact surface, and wherein the first guiding ramp contact surface is beveled in a second direction such that a protrusion extending from a distal end of the latch in the insertion direction is guided towards the inner back wall.

14. An electrical connector, comprising:

a connector housing, wherein the connector housing comprises a housing frame and a housing core, wherein the housing core can be inserted in the housing frame, wherein the housing core comprises a latch protruding from an outer wall of the housing core;

wherein the housing frame comprises a corresponding locking means arranged on an interior wall of the housing frame to engage said latch, wherein the housing core comprises a contact terminal receiving cavity;

wherein the corresponding locking means comprises a first guiding ramp and second guiding ramp each configured to guide the housing core into a proper position in the housing frame;

wherein the first guiding ramp is configured to contact the latch upon insertion of the housing core to guide the housing core parallel to an extension direction of the interior wall of the housing frame onto the second guiding ramp, wherein the second guiding ramp is arranged behind the first guiding ramp and is configured to contact the latch upon insertion of the housing core and is configured to deflect the latch inwardly towards the interior of the housing frame, wherein the corresponding locking means comprises a first inner side wall and a second inner side wall, and wherein gaps are formed along the first and second inner side walls in the insertion direction to create respective recesses between the first and second inner side walls and the first and second guiding ramps.

* * * * *